US006505998B1

(12) United States Patent
Bullivant

(10) Patent No.: US 6,505,998 B1
(45) Date of Patent: Jan. 14, 2003

(54) GROUND TREATMENT

(75) Inventor: Roger A. Bullivant, Burton-on-Trent (GB)

(73) Assignee: Global Innovations, Inc., Grand Prairie, TX (US)

( * ) Notice: Subject to any disclaimer, the term of this patent is extended or adjusted under 35 U.S.C. 154(b) by 0 days.

(21) Appl. No.: 09/486,188

(22) PCT Filed: Aug. 19, 1998

(86) PCT No.: PCT/GB98/02484

§ 371 (c)(1),
(2), (4) Date: Apr. 24, 2000

(87) PCT Pub. No.: WO99/09261

PCT Pub. Date: Feb. 25, 1999

(30) Foreign Application Priority Data

| | | |
|---|---|---|
| Aug. 20, 1997 | (GB) | 9717571 |
| Dec. 23, 1997 | (GB) | 9727003 |
| Jun. 13, 1998 | (GB) | 9812730 |
| Jun. 13, 1998 | (GB) | 9812732 |

(51) Int. Cl.[7] ..... E02D 27/26

(52) U.S. Cl. ..... 405/271; 73/12.13; 73/84

(58) Field of Search ..... 73/12.13, 84, 818, 73/784; 33/391, 392, 393, 394; 405/271, 129.15, 229, 231, 232, 302.4

(56) References Cited

U.S. PATENT DOCUMENTS

| | | | | | |
|---|---|---|---|---|---|
| 267,655 | A | * | 11/1882 | Vajen | 33/350 |
| 947,548 | A | * | 1/1910 | Lind | 404/133.1 |
| 3,204,414 | A | * | 9/1965 | Steuerman | 405/271 |
| 4,860,572 | A | * | 8/1989 | Brar et al. | 73/12.13 |
| 5,244,311 | A | | 9/1993 | Galante | 405/129 |
| 5,249,892 | A | | 10/1993 | Fox et al. | 405/233 |
| 5,622,016 | A | * | 4/1997 | Collins | 405/231 |
| 5,683,207 | A | * | 11/1997 | Mauer | 405/231 |

FOREIGN PATENT DOCUMENTS

| | | | |
|---|---|---|---|
| EP | 0 299 118 A1 | | 1/1989 |
| EP | 0 514 559 A1 | | 11/1992 |
| FR | 2 635 546 A1 | | 2/1990 |
| GB | 2286613 | * | 8/1995 |
| SU | 1463867 A1 | | 3/1989 |
| WO | WO 94/17252 A1 | | 8/1994 |

* cited by examiner

*Primary Examiner*—Heather Shackelford
*Assistant Examiner*—Sunil Singh
(74) *Attorney, Agent, or Firm*—Sidley Austin Brown & Wood LLP

(57) ABSTRACT

A ground treatment device (10) is weighted to provide ground treatment by dropping the device onto the ground. The device (10) has a relatively narrow nose (12) which provides, in use, the point of first contact with the ground. The device widens away from the nose (12), over a portion (14). A clevis arrangement (16) allows the device (10) to hang from a cable (18), to allow the device (10) to be raised by a crane, before dropping. A shoulder (22) projects outwardly and allows calibrated measurement of the degree of compaction achieved in the ground. Variations of the device (10) are described, together with apparatus for use in lifting and dropping the device, and methods of using the device.

45 Claims, 11 Drawing Sheets

GROUND TREATMENT

The present invention relates to ground treatment and particularly, but not exclusively, to the compaction of ground such as derelict industrial sites, in preparation for building.

The invention provides a ground treatment device, the device being weighted to provide ground treatment by dropping the device on the ground, and the device having a relatively narrow nose providing, in use, the point of first contact with the ground, and the device widening away from the nose.

Preferably the device is weighted to provide ground compaction. Preferably the nose is pointed. The nose may be the tip of a conical or frustoconical portion of the device. The device preferably has a shoulder which projects outwardly from the device. The shoulder may be an annular projection around substantially the whole periphery of the device. The device preferably widens from the nose to the shoulder. The shoulder is preferably spaced from the nose by a distance so chosen that, when the device is dropped from a predetermined height, the nose will embed in the ground without the shoulder reaching the ground if the ground is compacted to or above a predetermined degree. Preferably the shoulder will engage the ground if the ground is inadequately compacted, to resist the device becoming buried. The shoulder may be provided by a plate member. The plate member may be substantially square, preferably of side length of about 2 m.

Preferably the device widens away from the nose at an angle of substantially 45° or greater. The nose may be a substantially conical tip and may have a cone angle of substantially 45°. The base diameter of the conical tip may be approximately 1 m.

The device may comprise a body of substantially frusto-conical form, which may be located above the tip during use, and may have a cone angle greater than 14°, preferably in the region of 14–20°, for example 17°. The frusto-conical body may have a base diameter of about 1.5 m and may have a minimum diameter of about 1 m.

The device preferably comprises attachment means by which the device may hang prior to dropping, the hanging means being so located on the device as to cause the nose to be substantially the lowest part of the device when so hung.

Preferably the device has a weight of at least 2,500 kg, preferably at least 4,000 kg, and may be 15,000 kg. The device may have a nose of cross-section less than about 0.5 $m^2$.

In an alternative, the device may comprise a plurality of relatively narrow noses as aforesaid, which may be formed on respective projections from a common member. Each nose may be substantially conical or pyramidal. The common member may be a plate, which may be square, rectangular or circular. The projections may substantially tessellate across the surface of the common member. The projections may have a square or hexagonal base shape. In this alternative, the device may have a mass of at least 10,000 kg, or may be lighter.

Preferably the device comprises a common body to which a working portion may be detachably attached, whereby the working portion may be replaced by an alternative working portion. The device may comprise a plurality of working portions of respective forms.

Preferably, there is at least one working portion which is substantially or generally conical.

There may be at least one working portion which provides a plurality of noses projecting from a common member.

There may be at least one working portion which comprises an elongate and downwardly depending shaft having a relatively narrow nose formed at the bottom thereof.

Preferably the lower end of the shaft carries a head on which the nose is formed. The head may be enlarged in diameter relative to the shaft. The shaft may be approximately 5 m long.

Preferably there is at least one working portion which widens away from the nose when viewed in a first direction, and is substantially constant in width when viewed in a perpendicular horizontal direction.

Preferably a working portion may be attached to and detached from the common member while the common member remains attached to lifting means. The common member is preferably heavier than a working portion.

The invention also provides a ground treatment device, the device being weighted to provide ground treatment by dropping the device on the ground, and the device having a common body attachable to lifting means and to which a working portion may be detachably attached to provide the point of first contact with the ground, the working portion being replaceable by an alternative working portion.

Preferably the common body is heavier than a working portion, to provide the majority of the weight of the device. The working portion may have any of the features or combinations of features set out above.

The invention also provides a method of ground compaction, in which a ground compaction device is dropped to cause ground compaction, the device being so shaped as to embed when dropped, and in which the degree of compaction is monitored by dropping the said device onto compacted ground at a predetermined speed, and noting the depth to which the device becomes embedded.

The predetermined speed is preferably achieved by dropping the device from a predetermined height above the ground.

The device is preferably calibrated by selection of its shape and/or weight to cause the device to embed by less than a predetermined depth when the ground is compacted to or above a predetermined degree. The device is preferably formed to provide a visual indication of having embedded to the said predetermined depth. Preferably the device comprises a projection or marking spaced by the said predetermined depth from the lowermost point.

The device is preferably a ground compaction device according to any of the definitions set out above.

The ground may be prepared prior to compaction by forming columns of particulate material therein, for allowing water movement in the ground. The material of the columns may be stone, rubble or the like.

Preferably the holes formed in the ground by embedding of the compaction device are filled after compaction. The holes may be filled prior to monitoring the compaction attained. The holes are preferably filled by disturbing and levelling the surface of the area being compacted.

The invention also provides a method of forming a support within the ground, wherein a ground treatment device as aforesaid is dropped to create a void in the ground, and the void is filled with supporting material.

Preferably a pillar of particulate material such as stone, is first formed in the ground, the ground treatment device being dropped onto the pillar to form a void at the top thereof.

The supporting member may be concrete.

A pile may be driven into the ground, through the void. The void may be filled before the pile is driven. The pile may be driven by the ground treatment device.

The invention also provides ground compaction apparatus comprising a weight for compaction of the ground by impact, drive means operable to lift the weight prior to dropping, and control means operable to move the apparatus substantially automatically between drops of the weight.

Preferably the apparatus has ground wheels, skids or tracks by which the apparatus may be moved. Preferably the control means are operable to cause the apparatus to move while the weight is being lifted. The control means may cause the apparatus to move by a predetermined amount after each weight drop. The predetermined amount is preferably settable in accordance with the ground condition. The control means may comprise override means by which an operator may control the distance the apparatus moves after each drop, in response to the operator's assessment of ground condition.

The apparatus preferably moves with the weight at the rear of the apparatus.

Preferably fixed means are provided to define a line across ground to be compacted, the apparatus being operable to follow the defined line when moving. The fixed means may comprise a laser operable to project a beam across the ground to be compacted.

Preferably the apparatus is mounted on roadworthy ground wheels whereby the apparatus may be driven to an alternative site without external power.

Preferably the apparatus comprises guide means operable to guide the weight as it falls. The guide means may comprise slots which are substantially vertical in use, the weight having members which run in the slots as the weight falls. The drive means may be disengageable prior to dropping, whereby the weight may substantially freefall to the ground. The apparatus may further comprise releasable lock means operable to retain the weight in a raised position supported by the guide means, thereby removing load from the drive means prior to dropping the weight.

Preferably the guide means are mounted on sled means moved during use by dragging. The guide means may be movable to a stowed condition when not in use. The guide means may have two hingedly connected parts allowing stowage. Shock absorbing means may be provided for the guide means, to absorb shock imparted to the guide means on impact of the weight with the ground.

The invention also provides ground compaction apparatus comprising a weight for compaction of the ground by direct impact on the ground, drive means operable to lift the weight prior to dropping, and guide means operable to guide the weight as it falls.

The guide means may comprise slots which are substantially vertical in use, the weight having members which run in the slots as the weight falls. The drive means may be disengageable prior to dropping, whereby the weight may substantially freefall to the ground.

The guide means may be movable to a stowed condition when not in use. The guide means may have two hingedly connected parts allowing stowage. Shock absorbing means may be provided for the guide means, to absorb shock imparted to the guide means on impact of the weight with the ground.

The apparatus may further comprise releasable lock means operable to retain the weight in a raised position supported by the guide means, thereby removing load from the drive means prior to dropping the weight.

Preferably the apparatus has ground wheels or tracks by which the apparatus may be moved. The apparatus is preferably powered for movement. Control means may be operable to cause the vehicle to move between successive drops of the weight. Preferably the control means are operable to cause the vehicle to move while the weight is being lifted. The control means may cause the vehicle to move by a predetermined amount after each weight drop. The predetermined amount is preferably settable in accordance with the ground condition. The control means may comprise over ride means by which an operator may control the distance the apparatus moves after each drop, in response to the operator's assessment of ground condition.

The apparatus preferably moves with the weight at the rear of the apparatus. Preferably the guide means are mounted on sled means moved during use by dragging.

Preferably fixed means are provided to define a line across ground to be compacted, the apparatus being operable to follow the defined line when moving. The fixed means may comprise a laser operable to project a beam across the ground to be compacted.

Preferably th e guide means is movable to a stowed condition when not in use.

Preferably the apparatus is mounted on roadworthy ground wheels whereby the apparatus may be driven to an alternative site without external power.

The invention also provides a method of ground compaction, in which fixed means are provided to define a line across ground to be compacted, and compaction apparatus is arranged to follow the line so defined when moving between drops.

Preferably the fixed means comprises a laser to project a beam across the ground, the compaction apparatus having sensor means operable to detect and follow the beam.

Preferably the compaction apparatus is as defined in any of the definitions set out above.

The invention also provides a method of ground compaction in which initial ground compaction is achieved, and in which an ironing pass is then effected by using a ground treatment device having a plurality of upwardly widening noses is then dropped onto the ground being treated, and in which the ground being treated is subsequently rolled.

Preferably depressions formed by the noses are filled before rolling. Initial compaction may be achieved by means of a ground compaction device as set out above. The ironing pass preferably covers substantially the whole area of the ground.

Examples of the present invention will now be described in more detail, by way of example only, and with reference to the accompanying drawings, in which:

FIG. 1 is a schematic perspective view of a ground treatment device according to the invention;

FIGS. 2*a* to 2*e* are schematic vertical sections through the ground, showing the sequence of operations when the device of FIG. 1 is used for ground compaction in a method according to the invention;

Figure 10A:
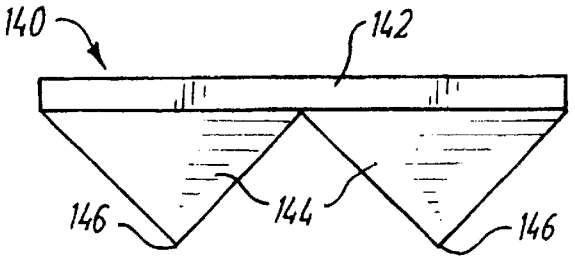
Figure 10B:
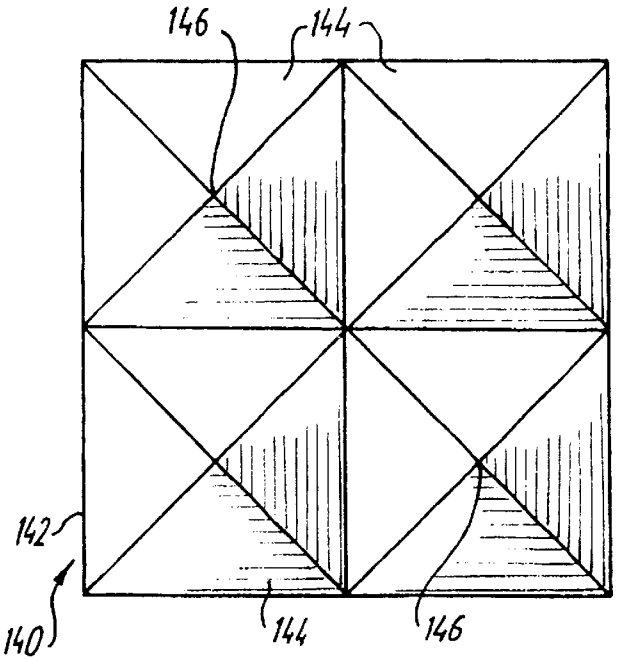
Figure 9A:
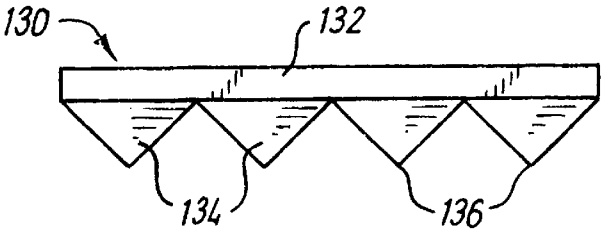
Figure 9B:
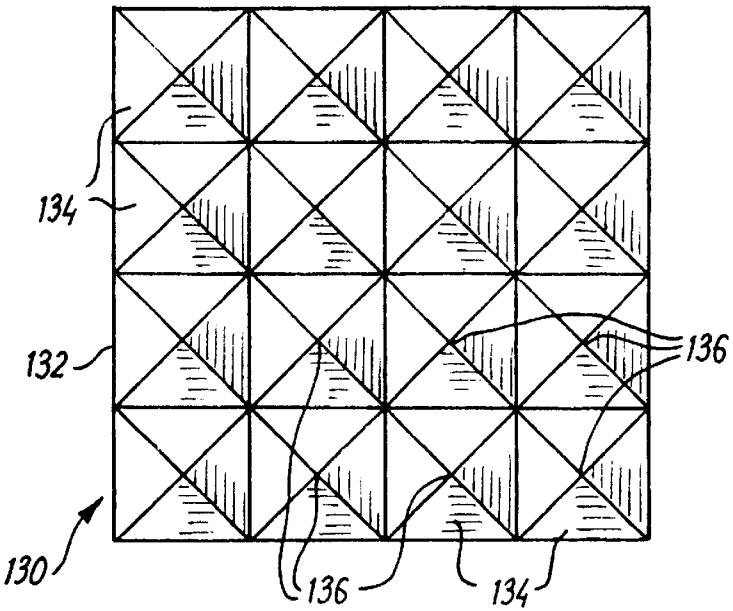
Figure 11A:
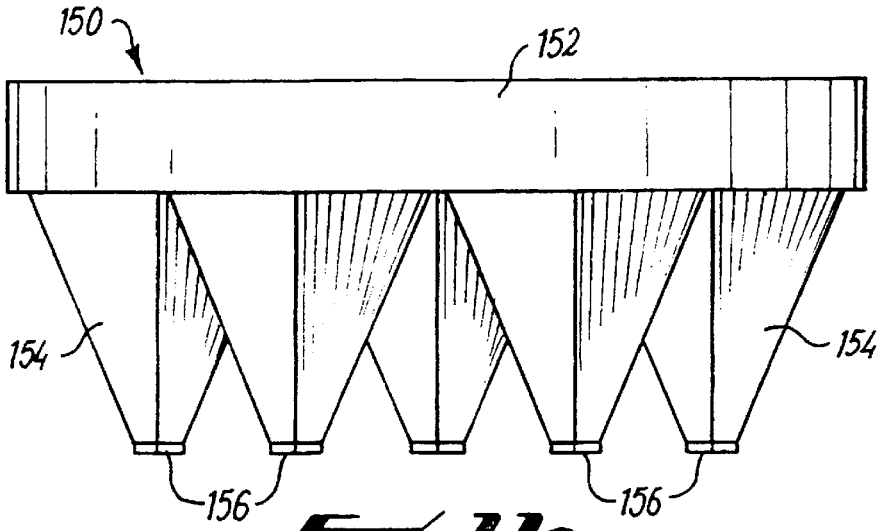
Figure 11B:
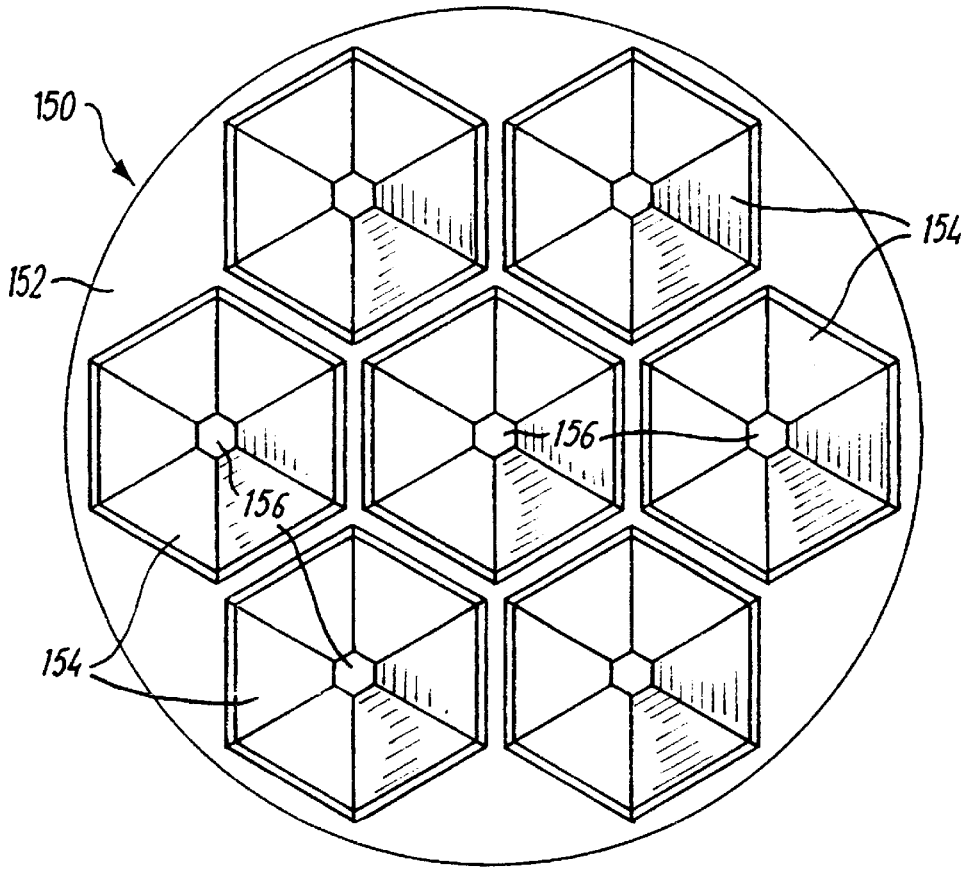

FIGS. 9*a* and 9*b* are, respectively, a side and underneath view of an ironing plate according to the present invention, FIGS. 10*a* and 10*b,* and FIGS. 11*a* and 11*b* show alternative ironing plates and otherwise correspond with FIGS. 9*a* and 9*b;*

Figure 12:
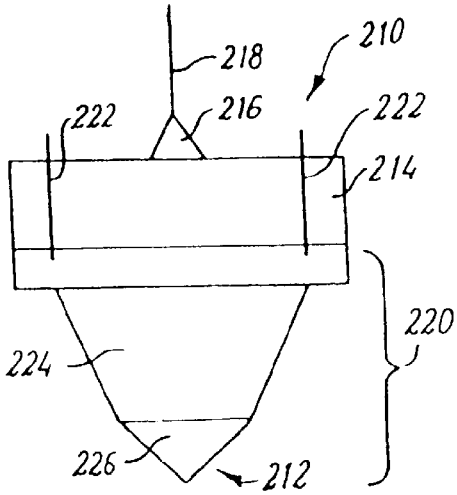
Figure 14:
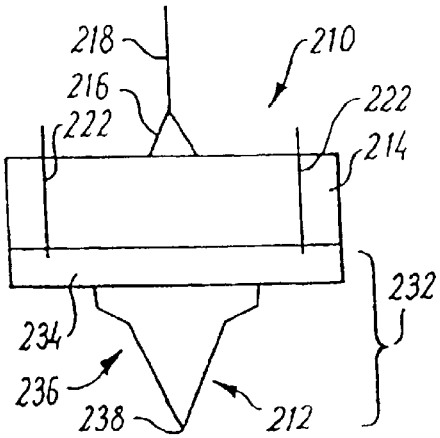
Figure 16:
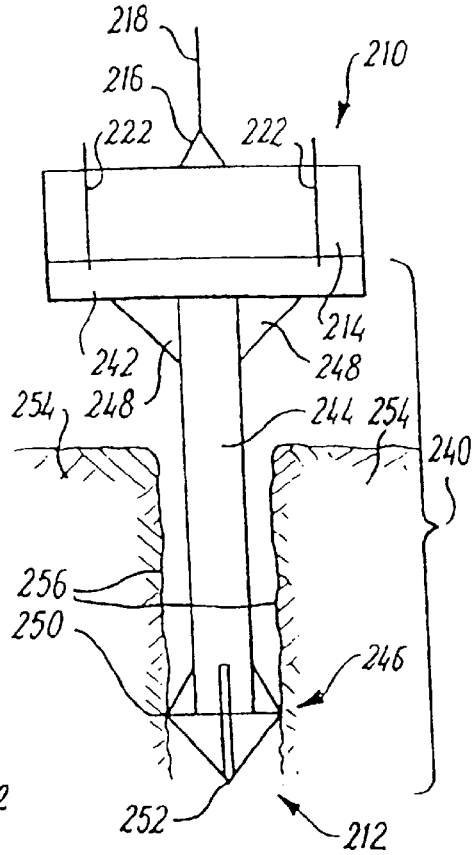
Figure 15:
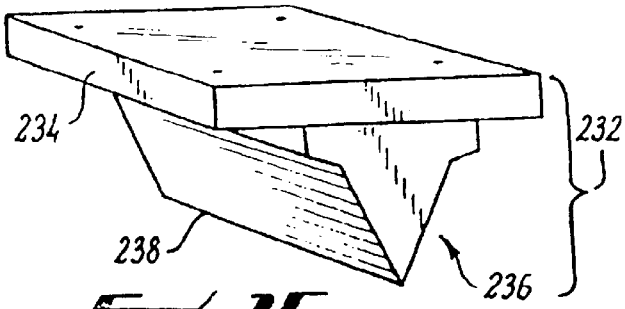
Figure 17:
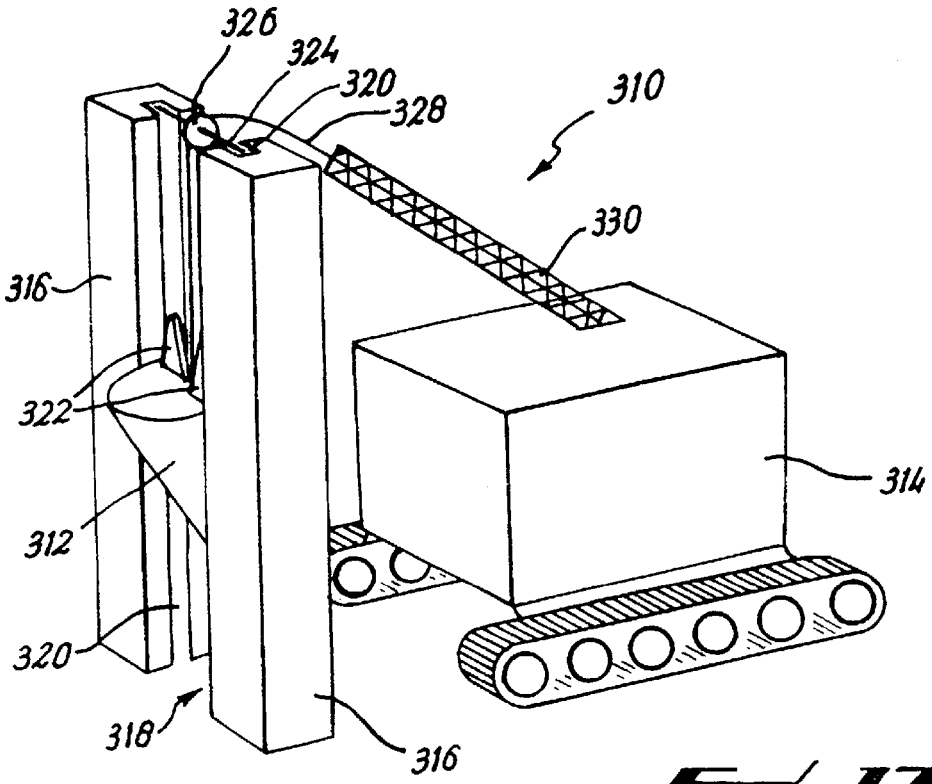
Figure 18A:
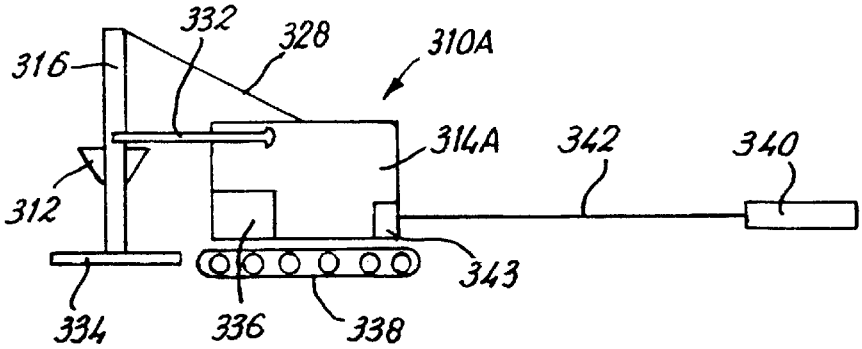
Figure 18B:
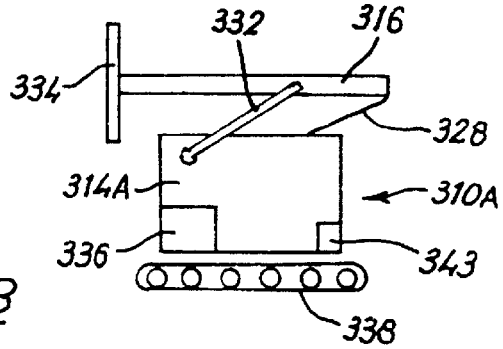
Figure 19A:
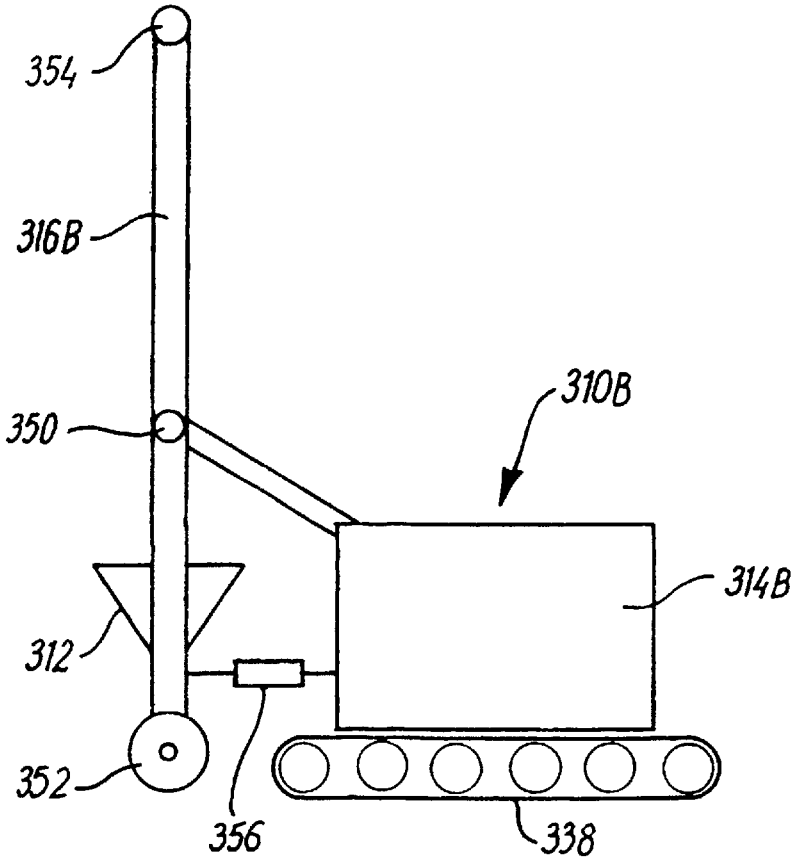
Figure 19B:
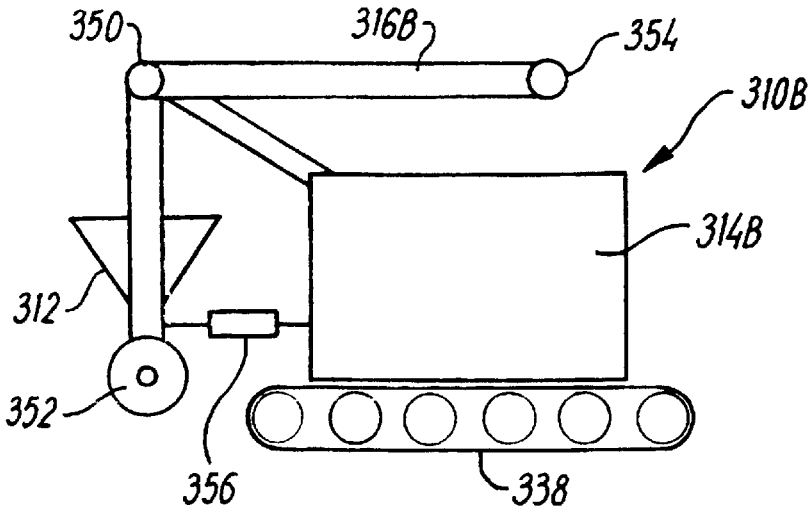

FIGS. 12, 13*a*, 13*b*, and 14 are schematic side elevations of a device according to the present invention, with alternative working portions fitted;

FIG. 15 is a schematic perspective view of the working portion shown in FIG. 14;

FIG. 16 is a view corresponding to FIGS. 12 to 14, showing a further alternative working portion in use;

FIG. 17 is a schematic perspective view of simple apparatus according to the invention;

FIGS. 18A and 18B schematically show an alternative version respectively in the use and stowed conditions; and FIGS. 19A and 19B correspond with FIGS. 18A and 18B and show a further alternative version.

Figure 1:
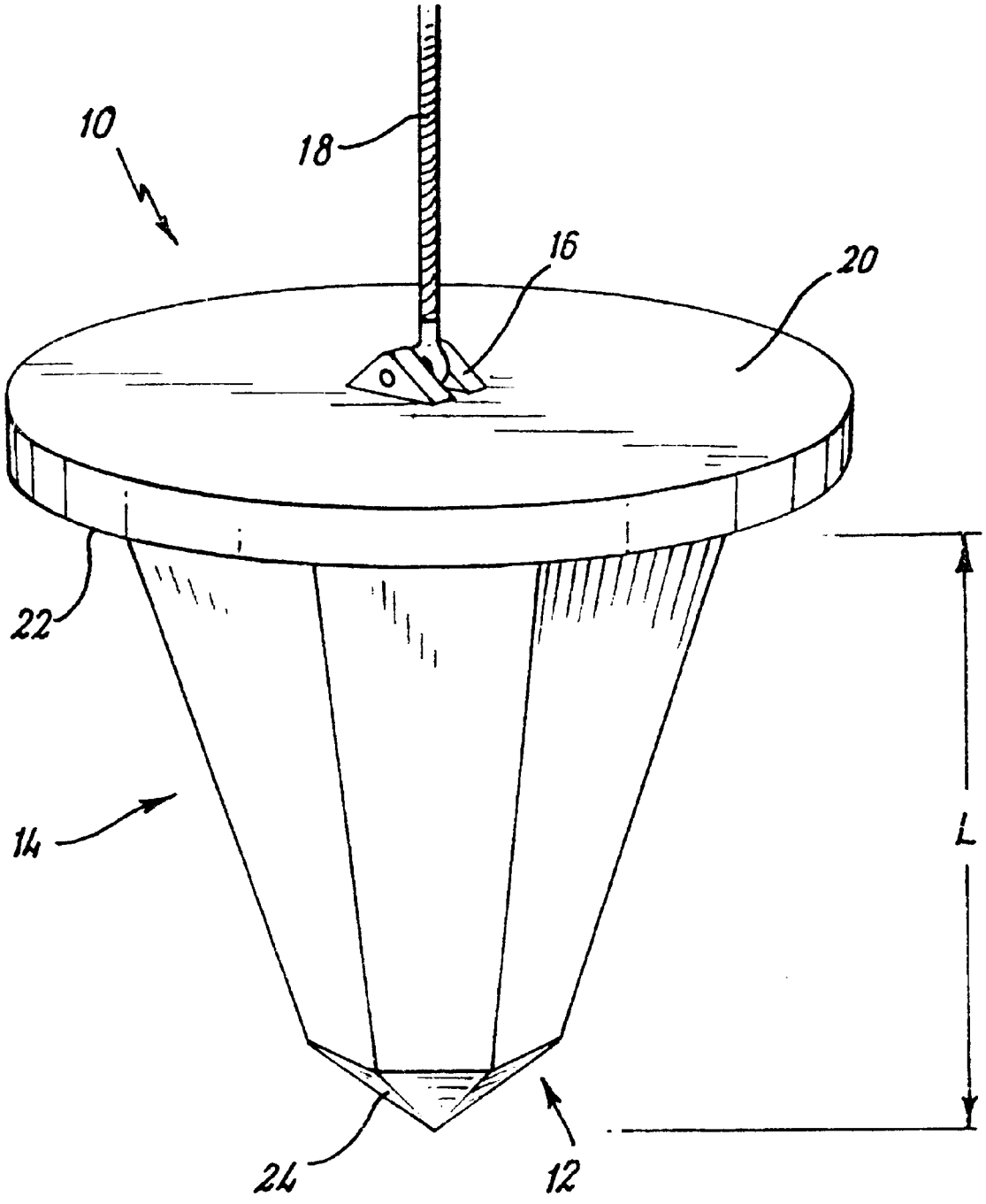

FIG. 1 shows a ground treatment device 10 which is weighted, as will be described, to provide ground treatment by dropping the device onto the ground. The device has a relatively narrow nose 12 which provides, in use, the point of first contact with the ground. The device widens away from the nose 12, over a portion 14.

In more detail, the device 10 has a clevis arrangement 16 by means of which it may hang from a cable 18 to allow the device 10 to be raised by a crane, and then dropped to the ground. Below the levis 16, a relatively wide disc 20 is arranged generally horizontally to form a shoulder 22 around substantially the entire periphery of the device 10. Below the shoulder 22, a generally frusto-conical portion 14 narrows from the shoulder 22 toward the nose 12. At the nose 12, a pointed tip 24 provides the point of first impact with the ground, and will always be lowermost in the device, by virtue of the location of the clevis 16.

Although described as frusto-conical, it can be seen that the portion 14 is faceted. However, other forms could be chosen. The disc 20 could also be made in shapes other than circular and in some situations, may not need to be continuous around the periphery of the device. However, it is important that the nose 12 is relatively narrow in comparison with the rest of the device. This will cause the device to embed in the ground when dropped, as will be described.

The separation of the tip 24 below the shoulder 22 is selected to calibrate the device 10 by setting the maximum depth by which the device can embed before the shoulder 22 engages the ground and prevents the device embedding further, or becoming buried. The diameter of the disc 20 can be increased as much as is considered desirable to ensure that the device does not become buried but it is important that the length L remains set to calibrate the device as will be described.

A method of compacting ground by using the device of FIG. 1 will now be described in more detail, with reference to FIGS. 2*a* to 2*e*.

Figure 2A:
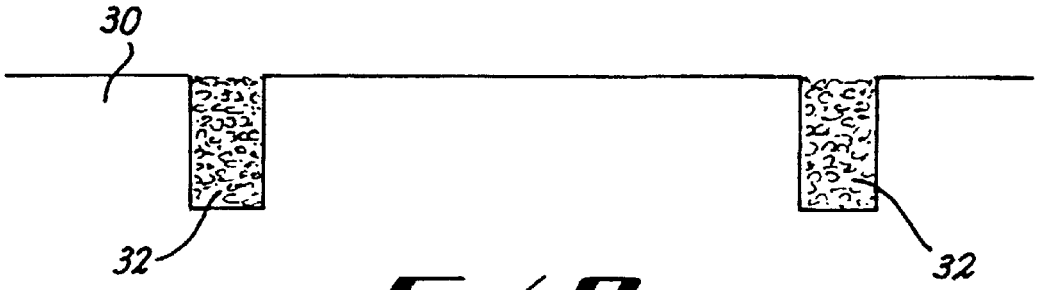

FIG. 2*a* shows the ground 30 after initial preparation (if required) by the provision of pillars 32 of stone or other particular material. The pillars 32 provide a sump for water to leave the ground 30, or into which water may surge under the influence of compaction forces. The pillars may be installed several days before compaction begins, to allow water to drain away, thus drying the ground between pillars. In other types of ground, particularly clay-based ground, water may remain within the ground until compression begins, but then be forced into the pillars 32 by the action of compaction. The provision of an escape route for this water helps prevent clay-based material from breaking down, by relieving pore pressure which builds up within the clay as a result of the compaction. The thixotropic nature of clay materials can cause them to break down into plate-like layers under compaction, these layers moving across each other without any compaction taking place, but it is found that if the water can leave the clay, this type of breakdown is less likely to occur. When the ground being compressed is more granular in nature, such as a sandy soil, water content is less likely to interfere with compaction, in which case it may not be necessary to provide pillars 32 as a preliminary step.

Figure 2B:
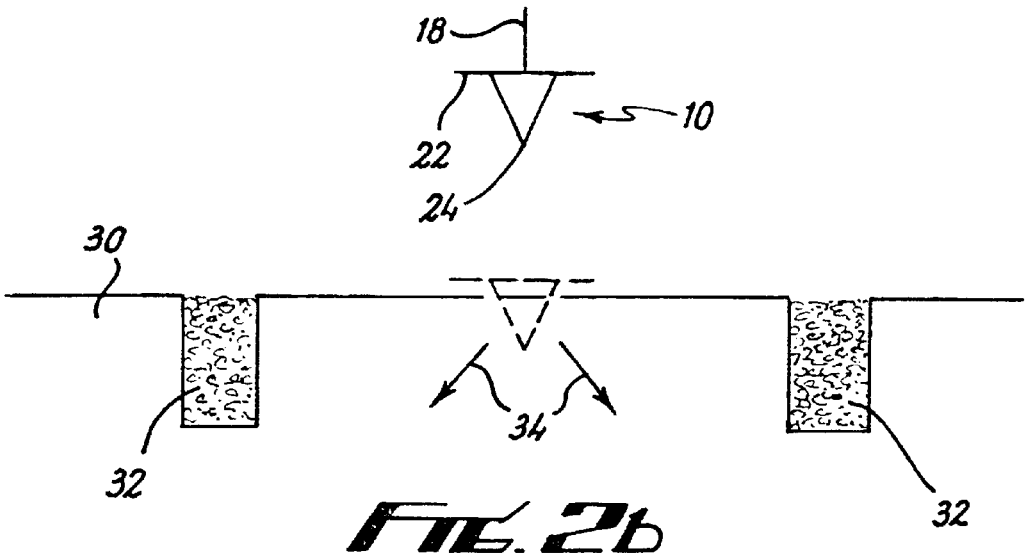

FIG. 2*b* indicates the start of the compaction operation. The device 10 is dropped, probably repeatedly and probably by means of a crane, onto the ground between adjacent pillars 32. As the tip 24 impacts on the ground 30, the device 10 will embed in the ground as indicated by the broken line outline. The conical or nearly conical nature of the device, in addition to causing the device to embed, will provide compaction forces generally in the directions indicated by the arrows 34 in FIG. 2*b*. The large weight and large height of drop, but the small (point) area ensure large penetration of the compaction forces, but not deep holes. In particular, the weight and size of the device can be chosen to cause the device to readily overcome the co-efficient of restitution of the ground (a measure of its elasticity). In particular, by using a heavy weight and large drop height, a large amount of energy is imparted on each drop, but is concentrated on a small area, thus providing highly efficient compaction.

Initially the ground may be soft and the device 10 may embed deeply but will be prevented from becoming buried, by the shoulder 22.

It will be readily understood by the skilled man that the pointed shape of the device 10 allows the impact with the ground to take place with much less violent production of dust clouds and debris than in the case of a conventional flat plate compaction device, or demolition ball, even if the energy delivered is greater. The pointed tip prevents ground vibration and is generally silent. However, more energy can be imparted to the ground, this being governed by the weight of the device 10 and the height from which it is dropped, but the energy is directed more deeply into the ground, as the arrows 34 indicate.

Figure 2C:
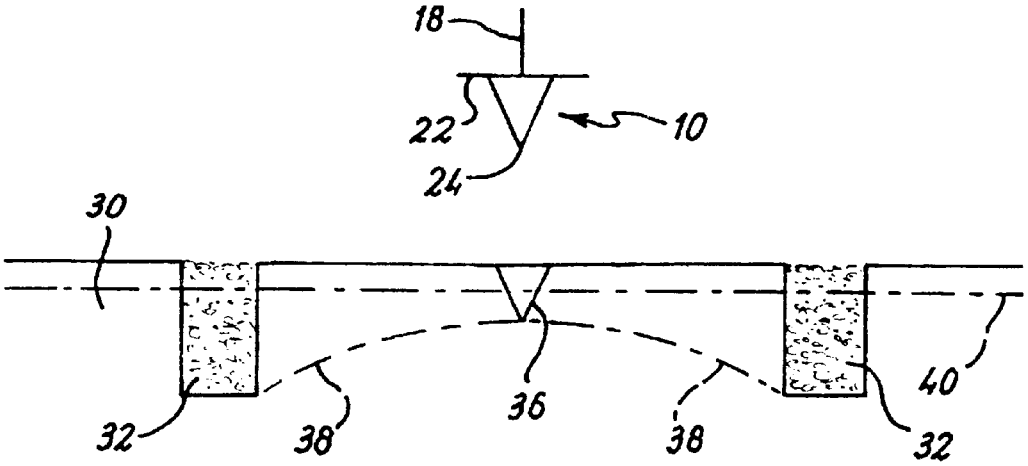

FIG. 2*c* indicates the position after the device 10 has been dropped and then removed from the ground 30. A depression 36 has been formed, and an arch 38 of compacted ground has been formed between pillars 32.

The device 10 can be repeatedly dropped into the depression 36, further increasing the compaction of the ground, until the operator assesses that an adequate degree of compaction may have been achieved. At this stage, the assessment will be achieved by judgement and experience, but unlike the situation with a conventional flat plate compaction device, the operator is assisted by the shape of the device 10 and the presence of the shoulder 22. The depth to which the device 10 is penetrating (and in particular, by noting whether the shoulder 22 reaches the ground or not) the operator is given a clear visual indication as to how compaction is progressing.

At this stage, an informal test can be carried out by dropping the device 10 from a predetermined height, thereby imparting a predetermined amount of energy to the ground beneath. By appropriately calibrating the device 10 by choice of the weight, predetermined height and length L from the tip 24 to the shoulder 22, the device 10 will embed to the shoulder 22 if the degree of compaction is at or below a predetermined degree. If that predetermined and desired degree of compaction has been achieved or exceeded, the shoulder 22 will just reach the ground, or will stop short of the ground. Thus, if the device 10 embeds with the shoulder 22 spaced above the ground 30 when dropped from the predetermined height, the operator can be confident that the ground has reached the desired degree of compaction.

Figure 2D:
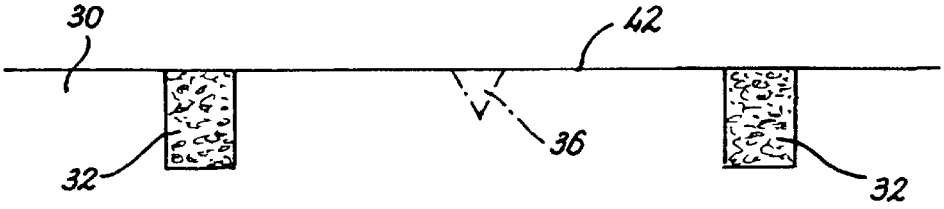
Figure 2E:
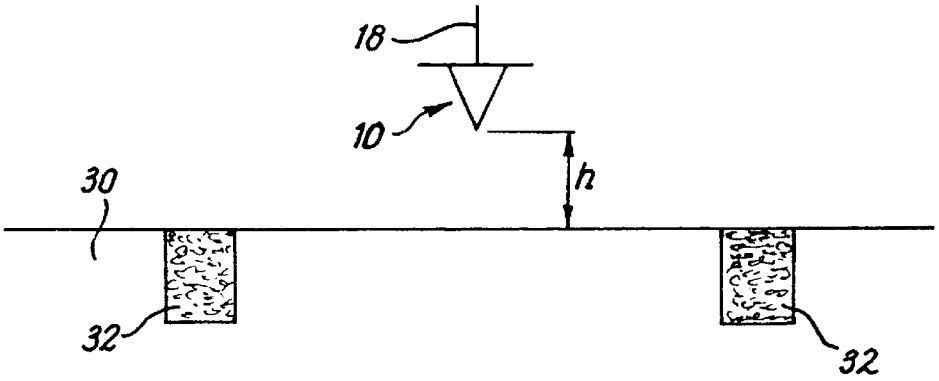

However, it is desirable for a more formal test to be conducted after the ground has been finished as indicated in FIG. 2*d.* To achieve this state, the surface of the ground is first disturbed above a level 40 indicated in FIG. 2*c,* preferably by means of a roller, such as a toothed roller, sheeps foot roller or pad foot roller, to rip up the surface and allow it then to be levelled, thus backfilling the depressions 36 and the tops of the pillars 32. After this rolling and backfilling a level surface 42 is achieved. A final test of the degree of compaction can then be made by dropping the device 10 from a predetermined height h (FIG. 2*e*), which would be carefully measured on this occasion to ensure that the speed at which the device 10 hits the ground, and thus the energy imparted by the impact, is precisely known. The ground is unambiguously identified as being adequately compacted if the result is to leave the device 10 embedded into the ground 30, but with the shoulder 22 spaced above the ground.

While each device 10 will have a predetermined height for testing, such as 4 m, it could be used for compaction from any height, particularly from a greater height to achieve compaction more quickly, such as 7 m.

It will be readily appreciated that devices 10 can be calibrated to measure different degrees of compaction either by simply varying the height h from which they are dropped, or by varying the weight and/or length L of the device 10. The degree of taper in the portion 14 may also affect the calibration. However, as has been said, once calibrated the device provides a continual opportunity for the operator to monitor compaction, while the compaction operation is underway, and then allows the operator to use the same device, crane and staff to conduct the test of compaction on site and readily by eye. Delicate test equipment, such as has previously been proposed, and complex analysis of test results, are not required.

The weight of the device will preferably be large, such as at least 2,500 kg, and preferably 4,000 kg or more. (Devices weighing up to 15,000 kg or more are envisaged). In one example, the dimensions of the device could be approximately as follows:

Diameter of nose 12: between 350 mm and 700 mm

Width of portion 14 at shoulder 22: between 75-mm and 1–5 m

Weight: 2½ tonne to 15 tonne

Drop height for compaction: 4 m to 15 m

A device with these dimensions is expected to be able to compact soil to a degree of compaction capable of supporting at least 10 $T/m^2$, and then test for adequate compaction. The device may be used to impart energy of up to 100 Tm or more, per drop.

It is envisaged that the shoulder 22 could be replaced by a marking on the surface of the device 10, so that the judgement of compaction could be made according to whether or not the mark goes below ground level on impact. While that arrangement would achieve the same calibration and testing advantages of the invention, the device would not be prevented from being buried in soft ground when compaction begins.

The great weight of the device 10, when used for testing, better allows the arrangements to ensure consistency at positions spread across a large area being treated.

The ground treatment device 10 can be used in other ways, as illustrated in FIGS. 3 to 8.

Figure 3:
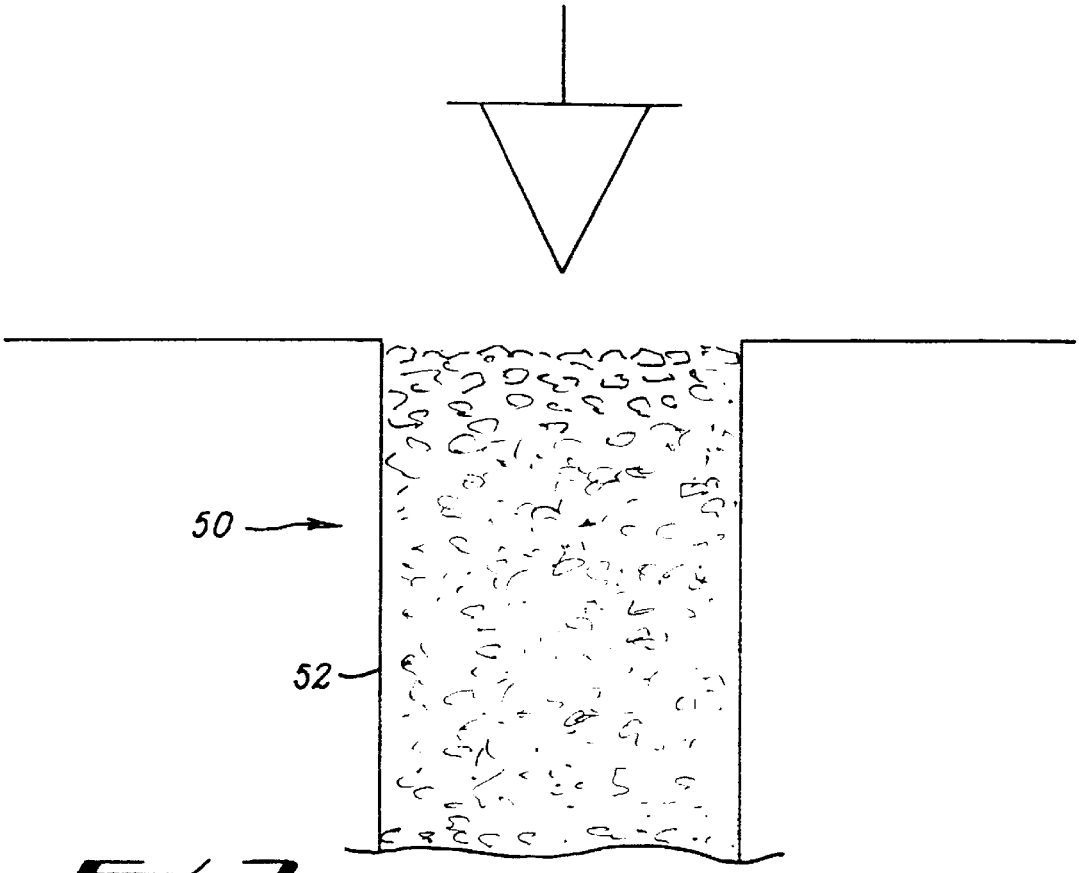
FIG. 3 is a schematic vertical section through a column to be further treated.
Figure 4:
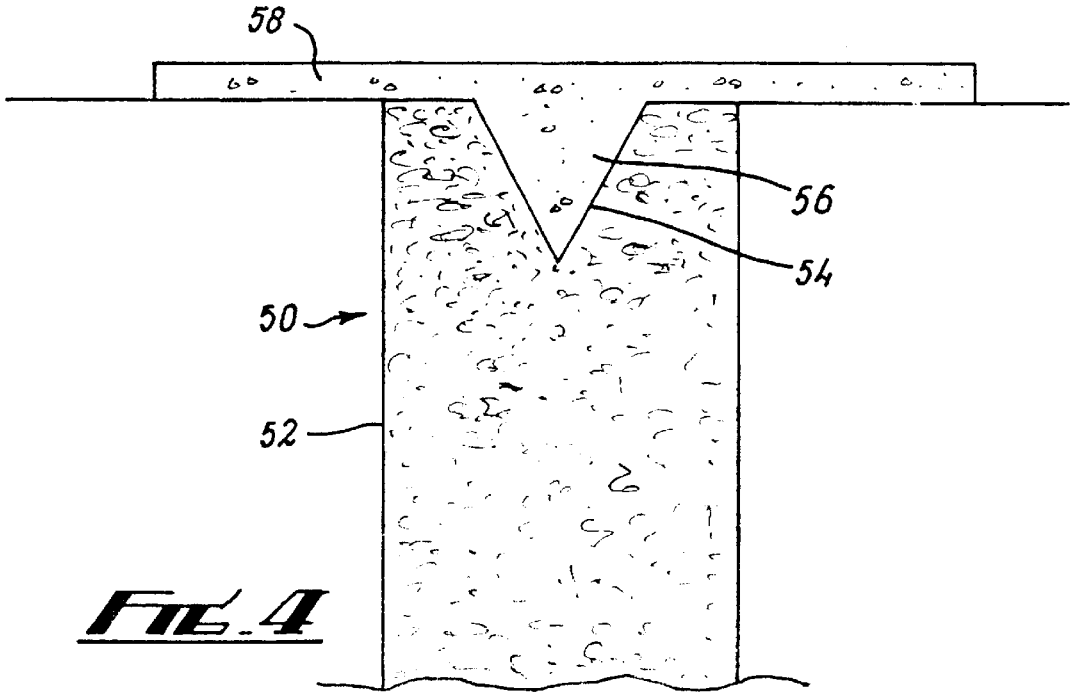
FIG. 4 shows the column of FIG. 3 after further treatment.

FIG. 3 is a section through a pillar 50 similar to the pillars 32, but shown on an enlarged scale. The pillar has been formed by creating a vertical hole 52 in the ground, and filling this with particulate material such as stone. The purpose of the pillar 50 may be primarily for drainage and surge reduction as described above. However, the device 10 allows the pillar 50 to be used to assist in support of a building to be built above the ground. If the device 10 is dropped onto the pillar 50, as indicated in FIG. 3, a void 54 will be created at the top of the pillar 50, if the drop height for the device 10 is sufficiently high. The void 54 is then filled with concrete 56, together with other reinforcement or bolts for holding down a building or its foundations, as indicated in FIG. 4. A raft 58, such as a concrete raft can then be formed over the pillar 50, to be supported by the concrete 56 and pillar 50.

Figure 5:
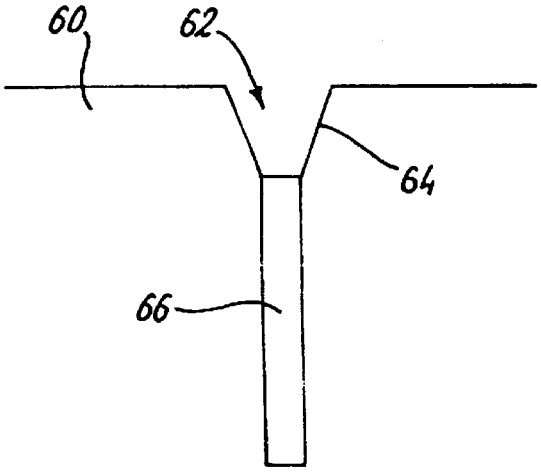
FIG. 5 is a schematic vertical section through a pile formed by using the device of FIG. 1.

In an alternative arrangement illustrated in FIG. 5, compacted ground 60 (compacted by the technique described above, or otherwise) can be pierced at 62 by dropping the device 10 to form a void 64. Since the ground 60 has already been compacted, it would usually be necessary to drop the device 10 from a height greater than the testing height in order to achieve an adequately large void 64. After forming the void 64, a pile 66 can be driven down through the void 64 into the ground beneath. The void 64 can be filled with concrete, such as lean-mix concrete, or stone, to form a mushroom head of generally conical form at the top of the composite pile so formed. If a concrete slab is then installed over the pile, this mushroom head helps protect the slab from the effect of shear forces. The mushroom head formed in this arrangement and the arrangement shown in FIG. 4 also helps meet the twin requirements of load support and bending moment resistance required in this type of application.

In the arrangements of FIGS. 4 and 5, the mush room head could be formed of stone or concrete. In FIG. 5, the pile could be driven while concrete in the mushroom head is still wet.

Figure 6:
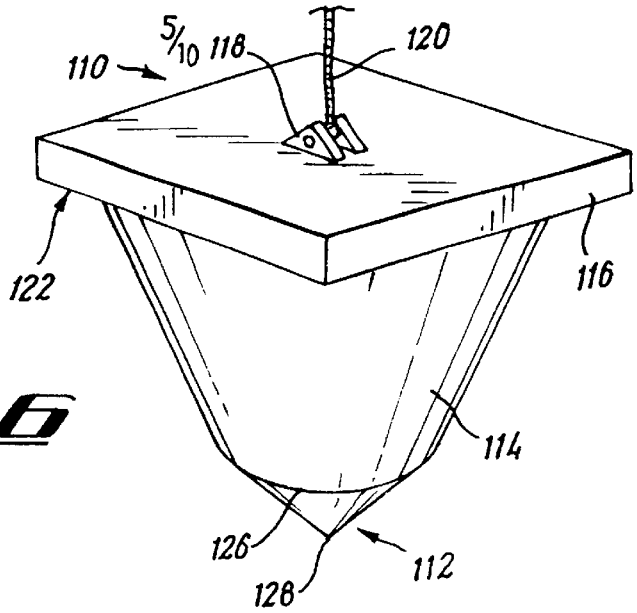
FIG. 6 is a schematic perspective view of an alternative ground treatment device according to the invention.
Figure 7:
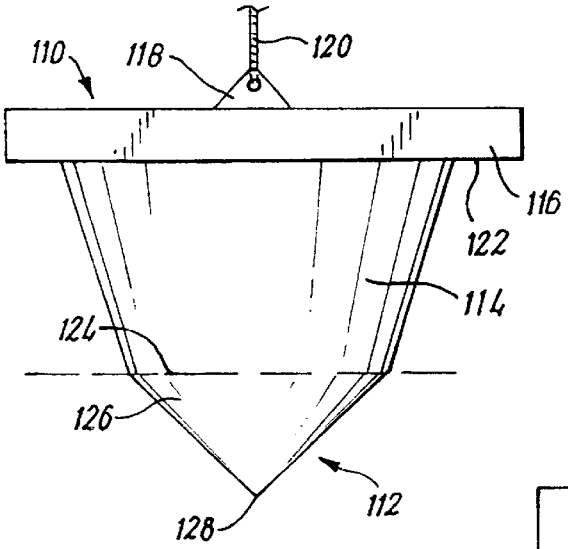
FIG. 7 is a schematic vertical section through the centre line of the device of FIG. 6.
Figure 8:
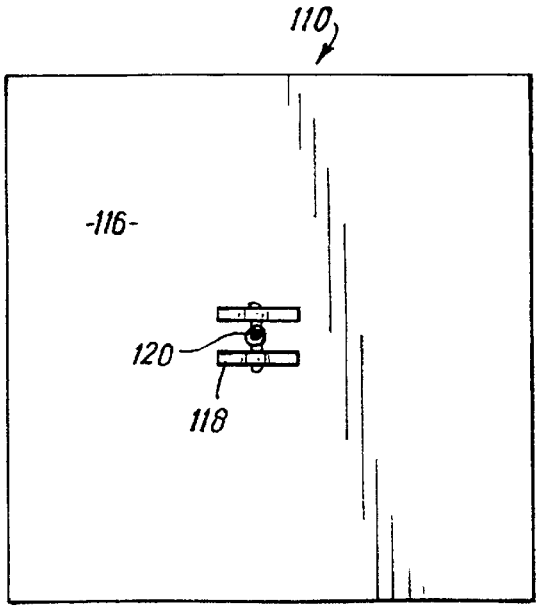
FIG. 8 is a schematic plan view of the device of FIG. 6.

FIG. 6 shows a further example of a ground treatment device weighted to provide ground treatment by dropping the device onto the ground. The device 110 has a relatively narrow nose 112 which provides, in use, the point of first contact with the ground. The device widens away from the nose 112, toward a portion 114 and then to a plate 116.

In more detail, the device 110 has a clevis arrangement 118 by means of which it may hang from a cable 120 to allow the device 110 to be raised by a crane and then dropped to the ground. Below the clevis 118, the plate 116 is arranged generally horizontally to form a shoulder 122 around substantially the entire periphery of the device 110. Below the shoulder 122, a generally frusto-conical portion 114 narrows from the shoulder 122 toward a line 124 at which the portion 114 meets the nose 112. The nose 112 is in the form of a conical tip 126 which narrows to a point at 128.

When the device 110 is hanging from the cable 120, the point 128 will be lowermost in the device 110 and thus make first impact with the ground when the device 110 is dropped.

The tip 126 is an inverted cone widening from the point 128 toward the line 124 with a cone angle of substantially 45°. ("Cone angle" is used herein to refer to the angle between the central axis of a cone and the surface of the cone, at the point of the cone). The cone angle of the tip 126 could be greater than 45°, indeed, the cone angle could be as great as 90°, representing the device 110 having a flat face along the line 124.

The frusto-conical portion 114 has, in this example, a diameter of 1 m at the line 124, and widens with a cone angle of 14° or greater to a base diameter of 1.5 m at the plate 116. It is important that the cone angle of the frustoconical portion 114 is greater than 14° (the so called "Morse angle"), for reasons which will be explained below. In a preferred arrangement, the cone angle of the frusto-conical portion 114 may be between 14° and 20°, preferably 17°. With a cone angle of about 17°, the portion 114 will widen from 1 m diameter to 1.5 m diameter over a cone height of about 0.8 m.

In the example illustrated, the plate 116 is square, as can be seen in FIG. 6, with a side length of substantially 2 m.

The device 110 is intended for use in the ground compacting method described above in relation to FIGS. 2*a* to 5. The device is raised by the cable 120 and then dropped onto the ground. As the tip 126 impacts on the ground, the device will embed in the ground. However, it will be understood that by virtue of the substantially 45° cone angle of the tip, forces imparted to the ground at the moment of impact will have components vertically downward and horizontally, but substantially no component vertically upward.

The shoulder 122 allows the device to be used simultaneously to compact the ground and to measure the degree of compaction achieved. By dropping the device 110 from a predetermined height, thereby imparting a predetermined amount of energy to the ground beneath, and by calibrating the device 110 by choice of the weight, drop height and length from the tip 26 to the shoulder 122, the device 110 will embed to the shoulder 122 if the degree of compaction is at or below a predetermined degree. If that predetermined and desired degree of compaction has been achieved or exceeded, the shoulder 122 will just reach the ground, or will stop short of the ground as the device embeds. Thus, if the device 110 embeds with the shoulder 122 spaced above the ground when dropped from the predetermined height, the operator can be confident that the ground has reached the desired degree of compaction.

The weight of the device is sufficient to cause significant ground treatment effect when dropped, preferably to cause adequate compaction in a single drop in many circumstances. For instance, the device may have a mass of at least 2,500 kg and would preferably considerably more, such as 8,000 kg.

It is believed that the efficiency of the compaction is improved in relation to known compaction techniques in which flat plates are dropped onto the ground. Primarily, the energy imparted by the falling device 110 is imparted to the ground through a smaller area than would be the case with a flat plate. Consequently, there is a smaller area at the point of impact and thus a smaller region in which the coefficient of restitution (Young's Modulus) of the ground needs to be overcome before effective conditioning work can take place. Consequently, a smaller part of the imparted energy is lost in overcoming the coefficient of restitution, and more is used for ground treatment, thus resulting in a greater efficiency for the operation.

Some simple calculations can illustrate the effectiveness of the device.

Since the energy imparted to the ground by dropping the device must be substantially equal to the energy absorbed by the treatment operation (ignoring small, unquantifiable losses), we can say:

$$W \times H \times \text{Eff} = R \times p \times S.F.$$

where:

W=weight of device (here 80 kN)

H=height of drop (here 10 m)

Eff=efficiency of the system including losses due to overcoming the coefficient of restitution (i.e. ground elasticity) (assumed here to be approximately 60%)

R=ground resistance achieved by the compaction p=average distance of penetration of the cone (ignoring the 500 mm depth of the tip 128)

S.F.=required safety factor in the calculation, here taken as 3 to offset long term settlement of the resulting structures We thus have, for a device according to the invention:

$$80 \times 10 \times 0.6 = R \times 0.8/2 \times 3$$

and therefore:

$$R = 400 \text{ kN}$$

A similar calculation can be made for a conventional flat plate. A flat plate of side length 2 m would treat an area of 4 $m^2$ in a single drop, and impart the same amount of energy (assuming the same weight and drop height). The area treated by the device of FIG. 1 would depend on the depth of penetration (because of the taper) but could be assumed to be about 1.25 $m^2$, based on the diameter mid-way up the frusto-conical portion 114. Thus, the flat plate would give an R value, based on the ratio of these areas, of:

$$R = 400 \text{ kN} \times 1.25/4 = 125 \text{ kN}$$

If the efficiency of a flat plate is less than that for a device according to the invention, which is likely in view of the larger area, the R value achieved by the square plate would be even lower.

When the device 110 has embedded in the ground, it can readily be removed by lifting on the cable 120, because the cone angles of the portion 114 and of the tip 126 are both greater than the Morse taper angle of 14°. In the case of the tip 126, the cone angle is much greater than the Morse angle. The Morse taper angle of 14° is generally considered the maximum angle which would ensure sticking of the embedded body within the hole created. Thus, by exceeding this angle, the device 110 will not stick, and can be removed.

FIGS. 9*a* to 11*b* illustrate examples of devices for use primarily in an "ironing pass", i.e. a final pass over the area being treated, with the intention of smoothing out any residual unevenness in the levels achieved, or in the degree of compaction achieved. (This could then be followed by further filling, if required, and by rolling by a suitable roller).

FIG. 9*a* shows a first ironing plate 130 comprising a common plate member 132 of square shape, and 2 m side length. The plate 132 is horizontal during normal use and carries an array of sixteen downwardly depending square pyramids 134, each having a relatively narrow nose 136 providing, in use, the point of first contact with the ground, and each pyramid 134 widening upwardly from the nose 136 to the plate 132. FIG. 9*b* shows the complete array of sixteen pyramids 134, which tessellate, by virtue of their square base shape, to cover the whole lower surface of the plate 132.

It can be readily calculated that if each pyramid has a slope of 45°, the pyramids will each have a base side length of 0.5 m, and a height of 250 mm. The noses 136 of the four pyramids 134 in the corners of the plate 132 will be separated by 1.5 m.

FIGS. 10*a* and 10*b* show an alternative ironing plate 140 which again comprises a plate 142 from which pyramids 144 depend, each having a nose 146 at the lowermost point, and widening from the nose 146 to the plate 142. In this alternative, the plate 142 again has side length of 2 m, but only four pyramids 144 are formed on the lower surface, each with a square base shape and base side length of 1 m, a slope of 45° and a height of 0.5 m. Again, it can be seen from FIG. 10*b* that each pyramid 144 abuts its neighbour along the whole of its side, so that the pyramids 144 together tessellate across the whole surface of the plate 142.

FIGS. 11*a* and 11*b* show a further alternative. In this case, the ironing plate 150 has a base plate 152 which is circular, with a radius of 1.5 m. The plate 152 may have a thickness of about 200 mm. Seven depending pyramids 154 are provided on the lower face of the plate 152, each having a hexagonal base shape, and tapering to a relatively narrow hexagonal nose 156. The pyramids 154 are arranged across the surface of the plate 152 to tessellate by virtue of their hexagonal shape.

The ironing plates shown in FIGS. 9 to 11 each preferably has a mass of at least 10,000 kg.

The ironing plates 130,140,150 can be used in the following manner. First, ground will be treated in other ways, preferably by means of a device such as that shown in FIG. 1 of FIG. 6, until a required degree of soil compaction has been achieved. This can however leave the surface layer still somewhat uneven or disturbed, and there may be local variations in the degree of compaction achieved. However, the ironing plate can then be used in a final pass over the site, dropping the plate onto the site at various positions across the site, in order to tamp down any unevenness in the top layer. This will further increase the compaction of the ground, but will do so in a manner which does not create unacceptable levels of noise, dust or other pollution. It may be desirable to fill any depressions (as illustrated in FIG. 2*d*) before or after the final pass with the ironing plate, and it may be desirable to roll the ground after the pass.

It will be apparent that many other arrangements of multiple cones (or other projection shapes) could be provided on the face of a plate, for use in an ironing pass. It will also be apparent that using square plates, as shown in FIGS. 9 and 10, allows the entire area of the ground to be covered in the ironing pass.

FIG. 12 shows a further example of a ground treatment device which is sufficiently heavy to provide ground treatment by dropping the device on the ground. The device 210 has a relatively narrow nose 212 which will provide the point of first contact with the ground during use. The device widens away from the nose 212.

In more detail, the device has a common body 214 in the form of a very thick, heavy plate of significant mass, such as 5–10 tonnes. The body 214 has an eye 216 to connect the body 214 to the cable 218 of a lifting arrangement such as a crane (not shown). The body 214 may be substantially square in plan, with a side length of about 2 m.

The device 210 also has a working portion 220 which is detachably attachable to the body 214 to hang below the body 214. In the drawings, the detachable attachment is schematically illustrated as through bolts 222 extending down through the body 214, to engage the working portion 220, but it will be readily appreciated that many alternative attachment arrangements could be used.

The working portion 220 of FIG. 12 is generally conical, having a first frusto-conical section 224, and a tip 226 at the lowermost extremity. The shape and dimensions of the generally conical portion 220 may be as set out above, and the manner of use of the device 210, and the advantages thereof, will be as set out a above.

The working portion 220 may have a mass of 1–2 tonnes, so that the working portion adds significant weight to the overall device, but nevertheless, the bulk of the weight is represented by the body 214.

Figure 13A:
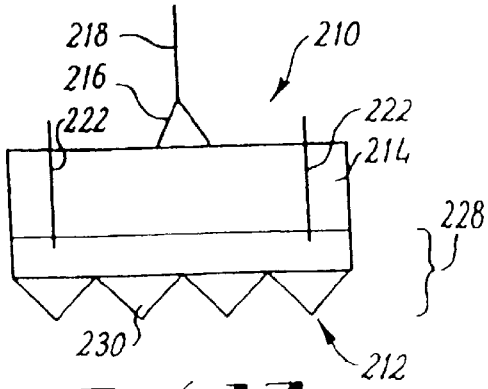
Figure 13B:
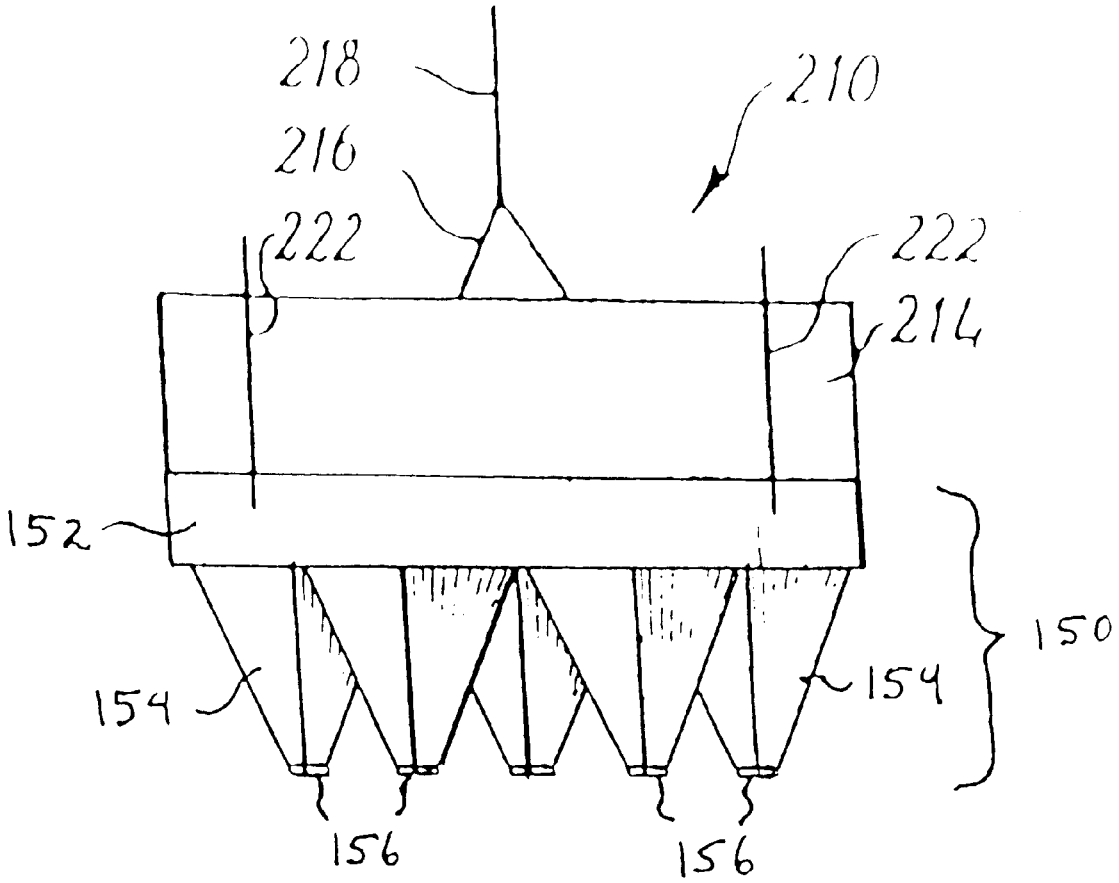

FIG. 13*a* shows the body 214 with an alternative working portion 228 attached. The portion 228 carries a plurality of downward projections 230, each of which may be substantially conical and otherwise as described above in relation to FIGS. 9 to 11. For instance, FIG. 13*b* shows the body 214 attached to the ironing plate 150 shown in FIGS. 11*a* and 11*b*.

The devices shown in FIGS. 12, 13*a,* and 13*b* can be used for ground treatment, particularly ground compaction, by first dropping the device of FIG. 12 to treat the ground by impact. The tapered shape of the portion 220 concentrates the energy to a relatively small area of ground, thereby increasing the effectiveness of compaction, and also allows the operator to judge the degree of compaction which has been achieved, by reference to the depth of penetration of the portion 220 into the ground.

Once the ground has been treated, the portion 220 can be lifted clear of the ground and then removed from the body 214 by releasing the bolts 222. The alternative portion 228 can then be attached, and the resulting device used for a final "ironing" pass as set out above, in order to smooth out any local variations in ground height or compaction achieved.

The act of replacing the portion 220 with the portion 228 is made easier by the f act that t he majority of weight of the device 210 is in the body 214, which does not need to be removed from the cable 218 in order to replace the working portion. From this point of view, the working portion could usefully be made as light as possible, for greater ease of replacement, but it is to be recognised that in view of the application, the working portions will necessarily need to be robust and will thus have significant mass, such as 1–2 tonnes.

FIG. 14 shows a further alternative working portion 232 and FIG. 15 shows the portion 232 alone, in perspective view. The portion 232 has a plate 234, such as $2m^2$, adapted for attachment to the body 214. A tip 236 extends down from the plate 234 and tapers to an edge 238. Viewed along the edge 238, the tip 236 tapers, as can be seen from FIG. 14. However, the tip 236 is of constant cross-section along the edge 238, as can be seen from FIG. 15, so that when viewed from the side (i.e. perpendicular to the edge 238), the tip 236 does not taper.

When attached to the body 214, the portion 232 can be dropped on the ground to form a generally V-shaped trench which can then be filled to create a foundation member such as a ground beam. It will be readily understood that alternative cross-sections could be used, if trenches of different shape were required. Again, it is to be understood that because the bulk of the weight of the device is in the body 214, it is relatively easy to install the portion 232 to change the device 210 for use in trench formation.

FIG. 16 shows a further alternative. In this case, the working portion 240 has a plate 242 for attachment to the body 214, and an elongate shaft 244 hangs downwardly from the underside of the plate 242, carrying an enlarged head 246 at the lower end thereof. The shaft 244 may be braced to the plate 242 by webs 248. The shaft 244 is preferably about 5 m in length.

The head 246 is enlarged relative to the shaft diameter and may, for instance, have a diameter of 450 mm at its widest point 250. Below the point 250, the head 246 tapers to a lowermost tip 252.

When hanging from the body 214, the portion 240 can be used to form ground columns, as follows. The device, with the portion 240 attached, can be repeatedly dropped onto the ground 254, each drop forcing the head 246 further down into the ground, thereby treating the ground below. In addition, the tapered shape of the head 246 improves the ground treatment achieved. The enlarged size of the head 246 allows relatively easy removal, because the shaft t 244 will be clear of the walls 256 formed around the column.

It is envisaged that the depth of penetration of the portion 240 can be used to measure the degree of ground compaction which has been achieved, in a manner described more fully in our co-pending applications set out above.

The shape of the portion 240 makes it readily useful for forming long, relatively narrow vertical holes in the ground, which can be filled, after removal of the portion 240, with stone or concrete to leave a column or pile in the ground, but adequately supported at its lower end by ground consolidated to a degree known from a consideration of the depth of penetration of the portion 240.

The apparatus described above, with interchangeable working portions is particularly envisaged for use with the ground compaction apparatus described below with reference to the remaining figures.

FIG. 17 shows ground compaction apparatus 310 which comprises a ground treatment device 312 for compaction of the ground by direct impact on the ground as has been described above. Drive means in the form of a crane 314 are operable to lift the device 312 prior to dropping, and guide means 316 operable to guide the device 312 as it falls.

In more detail, the guides 316 are pillars arranged to stand generally vertically to either side of the desired point of impact 318. The pillars 316 have vertical guide slots 320 which define the path of the device 312, as will be described. The device 312 is preferably a substantially conical or frusto-conical device as described above, to which additional vertical plates 322 are attached at the top of the device 312, to form ears which project sideways to run in the slots 320, thereby guiding the device 312 to fall substantially vertically.

A cross bar 324 and pulley wheel 326 are provided at the top of the pillars 316 to guide a cable 328 from the weight 312 over the wheel 326 to the crane 314. Consequently, the crane 314 can pull the weight 312 to raise it to the top of the pillars 316.

The pillars 316 are preferably provided with a lock or latch arrangement to hold the weight 312 at the raised position at the top of the pillars 316. For instance, a trip switch or other sensor (not shown) could be provided within the slots 320 to sense the arrival of the weight 312 at the top of the pillar 316, whereupon a locking member is advanced, preferably pneumatically or hydraulically, to sit underneath the lower edges of the gears 322 and provide support for the weight 312. The cable 328 can then be released by the crane 314, removing the weight from the crane 314, and particularly from its jib 330.

When the weight 312 is to be dropped, the lock arrangement is released and the weight 312 can then fall down the slots 320 to impact on the ground at 318. The drop height may be selected as described above, to provide a measured degree of compaction and to allow calibrated measurement of the calibration achieved.

It can be seen that the drop is initiated by the locks within the pillars 316, not by the crane 314. The jib 330 is thus protected from the sudden release of weight which would occur in the conventional arrangement where the weight is merely dropped by releasing the cable 328. This conventional arrangement causes a whiplash reaction in the jib 330 and of considerable violence, which can damage or reduce the life of the crane 314. This is undesirable in view of the value of cranes of appropriate size and power (preferably in the region of 700 horsepower or more in order to allow the weight 312 to be raised at a rate of about 2 meters per second).

Alternatively, the jib 330 could be rested on the pillars 316, to transfer the weight to them prior to the weight 312 being dropped. Again, this avoids a reaction on the jib 330, arising from the sudden release of the weight at the start of the drop.

In either arrangement, the result is to ensure the weight is substantially in free fall when it reaches the ground, with which it makes direct impact, with the advantages set out above.

Once the point 318 has been hit one or more times by the weight 312 to achieve an adequate degree of ground compaction, the arrangement shown in FIG. 17 is moved to the next required point of impact, put into position and then re-used. This movement may be arranged automatically by an arrangement such as will now be described.

FIGS. 18A and 18B show a modified embodiment. Many of the features of FIGS. 18A and 18B correspond to features of FIG. 17 and are given the same reference numerals. Others are given corresponding numerals with the suffix "A". However, in this arrangement, the crane 314 is adapted from a free-standing conventional crane by the permanent attachment of the pillars 316 by means of pivot arms 332. In addition, the feet of the pillars 316 are mounted on sled runners 334 which allow the pillars 316 to be moved by dragging it across the ground.

When the apparatus 310A is in use, as shown in FIG. 18A, its operation is substantially the same as described above in relation to FIG. 17. The crane 314A raises the weight 312 by drawing the cable 328, until the weight 312 reaches the top of the pillars 316 and is held by locks. Cable tension is then released. The locks can then be released to allow the weight 312 to free fall to make direct impact on the ground. It is desirable for the pillars 316 to be sufficiently long for adequate ground compaction to be achieved by a single drop in a wide range of situations, for economy of time.

The operations of raising the weight 312, sensing its arrival at the top of the pillar 316, locking it, releasing the cable tension and then releasing the weight 312 are preferably all controlled pneumatically or hydraulically and coordinated by a control apparatus indicated schematically at 336 and which may comprise a computer.

Additional sensors are provided for the computer 336 at the foot of the pillars 316 to sense the arrival of the weight 312. This initiates the next phase, in which the weight 312 is raised for a further drop. Preferably the ground wheels or self-laying tracks 338 of the crane 314A are operated simultaneously with the cable 328 being drawn, so that the crane 314A drags the runners 334 across the ground to the next drop position at the same time as the weight 312 is being raised. Consequently, time is not wasted waiting for the weight to rise or for the crane to move—the two operations can take place simultaneously. Once the crane has moved to the next position and the weight has reached the top of the pillars, the next drop can take place as described above.

In a preferred arrangement, the computer 336 is programmed to control the distance by which the pillars are dragged after each drop. In most situations, a survey will be made before work begins, to determine the desired separation of impact points and this separation can then be programmed into the computer 336 so that the crane 314 will automatically move the corresponding distance to separate consecutive impact points by the desired distance. While the desired separation will generally be used for substantially the whole area being compacted, there may be situations in which the quality of the ground varies considerably from place to place, for which situations it may be desirable to provide the human operator with an override control allowing the computer 336 to be overridden, so that separations can be increased or reduced temporarily, and then revert to the separation chosen before work began once the operator is satisfied that the local variation in ground condition has been passed.

A further feature of the arrangement of FIG. 18A concerns a laser 340 which can be located at a fixed location at one edge of the ground to be compacted, to project a beam 342 across the ground. The computer 336 is provided with a sensor 343 for the beam 342 and is programmed to follow the beam when moving, so that successive drop points are accurately positioned along a straight line. Once the crane 314A has moved right across the site, compacting the ground at the desired intervals, the laser 340 and crane 314A can be moved by a set distance perpendicular to the beam 342, whereupon a further straight line of accurately spaced impacts can be executed as described above. It will be understood that this represents a significant advantage over prior art techniques in which it was common for each desired impact point across the whole area of ground to be individually marked, such as by driving in marker posts, with the disadvantage that if it was then found necessary to bulldoze or roll the ground in the light of its condition, these marker points would be lost and would need to be remarked. The marking of these points on a large site can be a very time consuming and labour intensive task. In the present invention, this is overcome by using the laser 340. The only accurate measure required is to determine the next position of the laser 340 at the end of a run of the crane 314A. Thereafter, the computer 336 will space the impact points appropriately, according to its programming.

A further advantage of the arrangement of FIGS. 18A, 18B is indicated in FIG. 18B. The crane 314A and pillars 316 are a self-contained unit which can adopt a stowed condition, as shown in FIG. 18B, by pivoting the arms 332 up to bring the pillars 316 over the crane 314A and raise the runners 334 clear of the ground. The tracks 338 can then be used to drive the complete apparatus to a new site, under power provided by the same power source used to raise the weight 312, or to drive the unit onto other transport. The weight 312 would usually be removed before the pillars are swung to their stowed condition.

FIGS. 19A and 19B show, highly schematically, a further modified version. Again, many of the features correspond to features of FIG. 17 and are given the same reference numerals. Others are given corresponding numerals with the suffix "B".

In this arrangement, as with the arrangement of FIGS. 18A and 18B, the crane 314B is adapted by permanent attachment of the pillars 316B, in the following manner. The pillars 316B are divided into an upper and lower part by a hinge arrangement 350. The upper part of the pillars 316B, above the hinge 350, can hinge back over the crane 314B when not in use, for convenience in storage and transport. Appropriate drive arrangements will be provided for raising and lowering the upper portion of the pillar 316B, and for locking it into its working position. These arrangements may incorporate a sensor to determine if the pillars 316B are vertical.

The lower part of the pillars 316B, below the hinge 350, finishes in a ground-engaging wheel or foot 352 which helps carry part of the weight of the apparatus 310B during use, but which may be retractable (FIG. 19B) when not in use.

In this version, the weight 312 may be raised up the pillars 316B by a cable (not shown) and winding drum 354 mounted at the top of the pillar 316B and powered from the crane 314B. After the weight 312 has been raised, it is locked in position in the manner described above in relation to other versions, tension in the lifting cable is then released and the locks are released to allow the weight to fall. It is desirable for the drum 354 to be positively driven during falling, to ensure that cable plays out sufficiently fast to allow the weight to freefall. Alternatively, the cable could be disconnected from the weight 312 before each drop.

In this (and any of the other versions of the apparatus) various sensors could be incorporated in the legs 316, 316A, 316B to detect the height to which a weight 312 has been raised, so that this height can be selected by the operator. Trip switches could be used.

The embodiment of FIGS. 19A and 19B show a further arrangement for enhancing operation, for the following reasons. As the apparatus 310B moves across the ground, compacting the ground by repeated drops of the weight 312, situations will arise in which the ground in front of the apparatus 310B is differently compacted as compared with the ground underneath (and depending on which way the apparatus is being moved). As a result, the weight 312 will be dropping into ground which is more compact to one side of the drop point, than it is to the other. This, or other local variations in ground compaction level may cause a tendency for the weight 312 to deflect from the vertical drop direction, causing shock to the pillars 316B. It has been found advantageous to incorporate a shock absorber arrangement such as is indicated at 356, to assist in absorbing this shock. The arrangement could be based on a hydraulic accumulator system or other appropriately robust shock absorbing technology. The arrangement shown in the drawings particularly aim to absorb shocks in the fore and after direction, which are expected to be the most significant, but shock absorbing arrangements for absorbing shocks in other directions could be used alternatively or in addition.

It is to be understood that very many variations and modifications can be made to the apparatus described but without departing from the scope of the invention.

Very many other shapes of ground treatment device could be used and of working portion shapes could be designed, according to the nature and degree of ground treatment required.

The cranes could have self-laying tracks or road wheels and many other arrangements for stowing the pillars after use could be devised. They could be dismantled to a greater or lesser degree.

The pillars are described as being mounted on a sled to ensure adequate support on the ground during weight dropping, but wheels could alternatively be used. The complete operation could be manually controlled but it is considered beneficial to have computer control to a considerable degree, to ensure consistency. However, various overrides can be provided for reasons set out above or otherwise, as considered necessary. Overrides for safety reasons would be provided. Operation can be hydraulic or pneumatic with sensors being electrical or in other technologies.

It will be readily apparent that various features of the versions described above can be used in combinations other than those specifically described, but within the scope of the invention.

It is envisaged that removing the requirement to mark the whole site before dropping begins, and by making weight lifting and movement simultaneous, considerable time saving can result, with consequent reduction in the time taken to complete the job, reduced labour costs and the like.

Whilst endeavouring in the foregoing specification to draw attention to those features of the invention believed to be of particular importance it should be understood that the applicant claims protection in respect of any patentable feature or combination of features hereinbefore referred to and/or shown in the drawings whether or not particular emphasis has been placed thereon.

What is claimed is:

1. A method of ground compaction, comprising the steps of:

compacting the ground;

dropping an ironing ground treatment device onto the ground to effect an ironing pass after the step of compacting the ground, the ironing ground treatment device having a body and a working portion supported by the body, wherein the working portion includes a plurality of nose portions, each having a base for first contact with the ground during use, wherein each of the plurality of nose portions is tapered such that a width of each nose portion increases from the base of each respective nose portion towards the body, and wherein a portion of the body extends beyond the plurality of nose portions to provide a shoulder; and rolling the ground after the step of ironing the ground.

2. A method of ground compaction, according to claim 1, further comprising, before the step of rolling the ground, the step of filling depressions, formed by the plurality of nose portions during the step of dropping the ironing ground treatment device onto the ground to effect an ironing pass.

3. A method of ground compaction, according to claim 1, wherein the step of dropping a ground treatment device onto the ground to effect an ironing pass is applied to a whole area of the ground.

4. A method of ground compaction, according to claim 1, wherein the step of compacting the ground comprises a step of dropping an initial ground treatment device onto the ground to effect an initial compaction, the initial ground treatment device having a relatively narrow nose providing, in use, a first point of contact with the ground, the initial ground treatment device widening away from the nose.

5. A method of ground compaction, according to claim 4, wherein the nose of the initial ground treatment device is pointed.

6. A method of ground compaction, according to claim 4, wherein the nose of the initial ground treatment device is a tip of a conical or frusto-conical portion of the initial ground treatment device.

7. A method of ground compaction, according to claim 4, wherein the initial ground treatment device widens away from the nose thereof at an angle of substantially 45 degrees or greater.

8. A method of ground compaction, according to claim 7, wherein the nose is a substantially conical tip having a cone angle of substantially 45 degrees.

9. A method of ground compaction, according to claim 7, wherein the initial ground treatment device comprises a shaft having a substantially frusto-conical form, located above the nose during use, the shaft having a cone angle which is at least 14 degrees.

10. A method of ground compaction, according to claim 9, wherein the cone angle of the shaft is in a range of 14 degrees to 20 degrees.

11. A method of ground compaction, according to claim 10, wherein the cone angle of the shaft is 17 degrees.

12. A method of ground compaction, according to claim 11, wherein the working portion includes a plurality of shaft portions, each of the plurality of shaft portions extending between a respective nose portion and the body.

13. A method of ground compaction, according to claim 12, wherein each nose portion has a shape selected from the group consisting of conical and pyramidal.

14. A method of ground compaction, according to claim 12, wherein the body is a plate.

15. A method of ground compaction, according to claim 12, wherein each of the plurality of shaft portions is substantially tessellate across a surface of the body.

16. A ground treatment device, comprising:

a body; and a working portion, supported by the body, wherein the working portion has a base for first contact with the ground during use, wherein the working portion extends between the body and the base in an extending direction, wherein the working portion includes a faceted nose portion that includes at least all of the working portion extending away from the body from an interposing plane, said interposing plane being normal to said extending direction and being between the body and the base, wherein the faceted nose portion includes at least three facets, each of the at least three facets having a perimeter defined by a plurality of substantially straight edges, wherein the nose portion is tapered such that a width of the nose portion increases from the base of the nose portion towards the body, wherein a portion of the body extends beyond the nose portion to provide a shoulder which is spaced from the nose portion by a distance such that, when the ground treatment device is dropped from a predetermined height above the ground, the nose portion will embed in the ground without the shoulder reaching the ground if the ground is compacted to or above a predetermined amount, and wherein the ground treatment device is weighted such that the ground is treated when the ground treatment device is dropped onto the ground.

17. A ground treatment device, according to claim 16, wherein the shoulder, during use, will engage the ground if the ground is inadequately compacted, to resist the ground treatment device becoming buried in the ground.

18. A ground treatment device, according to claim 16, wherein the nose portion widens away from the base of the nose portion towards the body at an angle of substantially 45 degrees or greater.

19. A ground treatment device, according to claim 18, wherein the working portion includes a shaft having a substantially frusto-conical form, located above the nose portion during use, and having a cone angle greater than 14 degrees.

20. A ground treatment device, according to claim 19, wherein the cone angle is in a range of 14 to 20 degrees.

21. A ground treatment device, according to claim 20, wherein the cone angle is 17 degrees.

22. A ground treatment device, according to claim 16, wherein the working portion includes a faceted shaft.

23. A method of ground compaction, comprising the steps of:

dropping a ground compaction device at a predetermined speed to cause ground compaction, wherein the ground compaction device has a body and a working portion supported by the body, wherein the working portion includes a nose portion having a base for first contact with the ground during use, wherein the nose portion is tapered such that a width of the nose portion increases from the base of the nose portion towards the body, and wherein a portion of the body extends beyond the nose portion to provide a shoulder; and monitoring a degree of the ground compaction by noting a distance between the shoulder and the ground.

24. A method of ground compaction, according to claim 23, wherein the predetermined speed is achieved by dropping the ground compaction device from a predetermined height above the ground.

25. A method of ground compaction, according to claim 23, wherein the ground compaction device is calibrated by selection of at least one of its shape and its weight to cause the ground compaction device to embed into the ground by less than a predetermined depth when the ground is compacted to at least a predetermined degree.

26. A method of ground compaction, according to claim 25, wherein the ground compaction device is formed to provide a visual indication of having embedded to the predetermined depth.

27. A method of ground compaction, according to claim 26, wherein the ground compaction device comprises at least one of a projection and a marking spaced by the predetermined depth from a lowermost point of the ground compaction device, as oriented during use.

28. A method of ground compaction, according to claim 23, wherein the shoulder is spaced from the base of the nose by a distance such that, when the ground treatment device is dropped from a predetermined height above the ground, the nose will embed in the ground without the shoulder reaching the ground if the ground is compacted to or above a predetermined amount, and wherein the ground treatment device is weighted such that the ground is treated when the ground treatment device is dropped onto the ground.

29. A method of ground compaction, according to claim 23, wherein said nose portion is a faceted nose portion.

30. A method of ground compaction, according to claim 29, wherein the working portion includes a faceted shaft located between the nose portion and the body.

31. A method of forming a support within the ground, comprising the steps of:

forming a pillar of particulate material in the ground;

dropping a ground treatment device onto the pillar to create a void at the top thereof, wherein the ground treatment device has a body and a working portion supported by the body, wherein the working portion includes a nose portion having a base for first contact with the ground during use, wherein the working portion is tapered such that a width of the working portion increases from the base of the nose portion towards the body, and wherein a portion of the body extends beyond the nose portion to provide a shoulder;

driving a pile into the ground through the void; and filling the void with supporting material.

32. A method of forming a support within the ground, according to claim 31, wherein the particulate material is stone.

33. A method of forming a support within the ground, according to claim 31, wherein the supporting material is concrete.

34. A method of forming a support within the ground, according to claim 31, wherein said nose portion is a faceted nose portion.

35. A method of forming a support within the ground, according to claim 34, wherein the working portion includes a faceted shaft located between the nose portion and the body.

36. A ground treatment device, comprising:

a body; and a working portion supported by the body, wherein the working portion includes one or more faceted nose portions, each having a base for first contact with the ground during use, wherein the working portion extends between the body and each base in respective extending directions, wherein each faceted nose portion includes at least all of the working portion extending away from the body from a respective interposing plane, wherein each interposing plane is normal to the respective extending direction, and wherein each interposing plane is between the respective base and the body, wherein each faceted nose portion includes at least three facets, each of the at least three facets having a perimeter defined by a plurality of substantially straight edges, wherein each of said one or more nose portions is tapered such that a width of each nose portion increases from the base of each respective nose portion towards the body, wherein a portion of the body extends beyond said one or more nose portions to provide a shoulder, and wherein the ground treatment device is weighted to provide ground treatment upon dropping the ground treatment device onto the ground.

37. A ground treatment device, according to claim 36, wherein the working portion includes one or more shaft portions, each of the one or more shaft portions extending between a respective nose portion and the body.

38. A ground treatment device, according to claim 37, wherein the body is a plate.

39. A ground treatment device, according to claim 38, wherein the plate has a shape selected from the group consisting of square, rectangular, or circular.

40. A ground treatment device, according to claim 37, wherein at least one of the one or more shaft portions is faceted.

41. A ground treatment device, according to claim 36, wherein at least one of the one or more nose portions has a pyramidal shape.

42. A ground treatment device, according to claim 36, wherein the working portion includes an upper plate for supporting the one or more nose portions, wherein the upper plate of the working portion is detachably attachable to the body, wherein the working portion is capable of being replaced by an alternative working portion.

43. A ground treatment device, according to claim 36, wherein each of the one or more nose portions has a second width which is substantially constant from the respective base thereof towards the body.

44. A ground treatment device, comprising:

a body; and a working portion supported by the body, wherein the working portion includes one or more faceted nose portions, each having a base for first contact with the ground during use, wherein each of said one or more nose portions is tapered such that a width of each nose portion increases from the base of each respective nose portion towards the body, wherein a portion of the body extends beyond said one or more nose portions to provide a shoulder, wherein the ground treatment device is weighted to provide ground treatment upon dropping the ground treatment device onto the ground, wherein the working portion includes one or more shaft portions, each of the one or more shaft portions extending between a respective nose portion and the body, wherein the working portion includes an upper plate, wherein the one or more shaft portions is a plurality of shaft portions, and wherein each of the plurality of shaft portions substantially tessellate across a surface of the upper plate.

45. A ground treatment device, according to claim 44, wherein each of the plurality of shaft portions has a cross-sectional shape selected from the group consisting of square and hexagonal.

* * * * *

UNITED STATES PATENT AND TRADEMARK OFFICE

CERTIFICATE OF CORRECTION

PATENT NO. : 6,505,998 B1
DATED : January 14, 2003
INVENTOR(S) : Roger A. Bullivant It is certified that error appears in the above-identified patent and that said Letters Patent is hereby corrected as shown below:

Title page, Item [54] and Column 1, line 1,
Title, delete "GROUND TREATMENT", and insert -- COMPACTION DEVICE AND METHOD OF USING SAME --.

Column 4,
Line 7, delete "over ride", and insert -- override --.

Column 5,
Line 23, delete "levis", and insert -- clevis --.

Column 12,
Line 22, delete "f act that t he", and insert -- fact that the --.

Column 13,
Line 1, delete "shaft t 244", and insert -- shaft 244 --.

Column 17,
Lines 61-62, delete "claim 11", and insert -- claim 1 --.

Signed and Sealed this

Twenty-third Day of March, 2004

JON W. DUDAS
*Acting Director of the United States Patent and Trademark Office*